US011014780B2

(12) United States Patent
Koushik et al.

(10) Patent No.: US 11,014,780 B2
(45) Date of Patent: May 25, 2021

(54) ELEVATOR SENSOR CALIBRATION

(71) Applicant: Otis Elevator Company, Farmington, CT (US)

(72) Inventors: Sudarshan N. Koushik, West Hartford, CT (US); Paul R. Braunwart, Hebron, CT (US); Charles C. Coffin, Vernon, CT (US); Teems E. Lovett, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 860 days.

(21) Appl. No.: 15/642,439

(22) Filed: Jul. 6, 2017

(65) Prior Publication Data

US 2019/0010019 A1 Jan. 10, 2019

(51) Int. Cl.
*B66B 5/00* (2006.01)
*B66B 13/08* (2006.01)
*B66B 13/24* (2006.01)

(52) U.S. Cl.
CPC ..... *B66B 5/0018* (2013.01); *B66B 5/0037* (2013.01); *B66B 13/24* (2013.01); *B66B 13/08* (2013.01)

(58) Field of Classification Search
None
See application file for complete search history.

(56) References Cited

U.S. PATENT DOCUMENTS 4,649,515 A 3/1987 Thompson et al.
5,557,546 A 9/1996 Fukai et al.
5,597,988 A 1/1997 Skalski
5,760,350 A 6/1998 Pepin et al.
5,774,633 A 6/1998 Baba et al.
5,787,020 A 7/1998 Molliere et al.
(Continued)

FOREIGN PATENT DOCUMENTS

CN 100546896 10/2009
CN 102765642 11/2012
(Continued)

OTHER PUBLICATIONS

Z. Wan, et al., "Diagnosis of Elevator Faults with LS-SVM Based on Optimization by K-CV," Hindawi Publishing Corp., Journal of Electrical and Computer Engineering, vol. 2015, Article ID 935038, 2015, 8 pages.

(Continued)

*Primary Examiner* — Brent A. Fairbanks
(74) *Attorney, Agent, or Firm* — Cantor Colburn LLP

(57) ABSTRACT

According to an aspect, an elevator sensor calibration system includes one or more sensors operable to monitor an elevator system, an elevator sensor calibration device, and a computing system. The computing system includes a memory and a processor that collects a plurality of baseline sensor data from the one or more sensors during movement of an elevator component, collects a plurality of disturbance data from the one or more sensors while the elevator component is displaced responsive to contact with the elevator sensor calibration device during movement of the elevator component, and performs analytics model calibration to calibrate a trained model based on one or more response changes between the baseline sensor data and the disturbance data.

20 Claims, 7 Drawing Sheets

(56) References Cited

U.S. PATENT DOCUMENTS 6,330,935 B1 12/2001 Systermans
6,330,936 B1 12/2001 Lence Barreiro et al.
6,392,537 B1 5/2002 Tazumi et al.
6,439,350 B1 8/2002 Barreiro et al.
6,453,265 B1 9/2002 Dekhil et al.
6,477,485 B1 11/2002 Radulovic et al.
6,526,368 B1 2/2003 Coste et al.
6,543,583 B1 4/2003 Barreiro et al.
6,604,611 B2 8/2003 Liu et al.
6,854,565 B2 2/2005 Perala et al.
6,988,594 B2 1/2006 Deplazes et al.
7,143,007 B2 11/2006 Long et al.
7,280,988 B2 10/2007 Helsper et al.
7,423,398 B2 9/2008 Tyni et al.
7,434,666 B2 10/2008 Tyni et al.
7,503,434 B2 3/2009 Grundmann
7,546,903 B2 6/2009 Kattainen et al.
7,637,355 B2 12/2009 Tyni
7,650,970 B2 1/2010 Lelic et al.
7,703,579 B2 4/2010 Tyni et al.
7,729,806 B2 6/2010 Ohira
7,823,706 B2 11/2010 Tyni et al.
7,958,970 B2 6/2011 Ma et al.
8,653,982 B2 2/2014 Yulkowski et al.
8,678,143 B2 3/2014 Bunter
8,838,417 B2 9/2014 Rikkola et al.
9,033,114 B2 5/2015 Mizon
9,110,159 B2 8/2015 Vartanian et al.
9,120,646 B2 9/2015 Loeb et al.
9,309,089 B2 4/2016 Annen et al.
9,535,808 B2 1/2017 Bates et al.
9,906,112 B2 2/2018 Dwari et al.
2002/0193920 A1 12/2002 Miller et al.
2003/0217894 A1* 11/2003 Perala ..... B66B 5/0006 187/316
2005/0034931 A1 2/2005 Deplazes et al.
2005/0167204 A1 8/2005 Husmann et al.
2006/0037818 A1* 2/2006 Deplazes ..... G08B 13/1961 187/392
2007/0016332 A1* 1/2007 Tyni ..... B66B 5/0037 700/275
2008/0230326 A1 9/2008 Tyni et al.
2009/0166134 A1 7/2009 Jahkonen
2012/0041575 A1 2/2012 Maeda et al.
2012/0193169 A1* 8/2012 Mizon ..... B66B 1/3492 187/247
2014/0337256 A1* 11/2014 Varadi ..... G05B 13/04 706/12
2015/0083528 A1 3/2015 Kattainen et al.
2015/0321884 A1 11/2015 Kalliomaki et al.
2016/0096272 A1 4/2016 Smith et al.
2016/0109229 A1* 4/2016 Yeum ..... G01B 11/27 33/194
2016/0185569 A1 6/2016 Sonnenmoser et al.
2016/0203036 A1 7/2016 Mezic et al.
2016/0330225 A1 11/2016 Kroyzer et al.
2016/0371599 A1 12/2016 Nicholas et al.
2017/0029246 A1* 2/2017 Kulak ..... B66B 13/24
2017/0235857 A1* 8/2017 Haye ..... G05B 23/0256 703/7
2017/0313552 A1* 11/2017 Hubbard ..... G01G 19/52
2018/0066943 A1* 3/2018 Bortolami ..... G01C 25/005
2018/0319015 A1 11/2018 Sinyavskiy et al.
2019/0010020 A1 1/2019 Koushik et al.
2019/0010021 A1 1/2019 Sarkar et al.

FOREIGN PATENT DOCUMENTS

CN 103678952 3/2014
CN 102482057 12/2014
CN 103303758 1/2016
CN 105731209 7/2016
CN 104291174 9/2016
EP 1556303 6/2006
EP 2562614 2/2013
EP 2813911 6/2013
JP H03106774 5/1991
JP 10265154 10/1998
JP 5189340 4/2013
JP 5544885 7/2014
WO 2005015326 2/2005
WO 2008006116 A2 1/2008

OTHER PUBLICATIONS

EP Application No. 18181963.2 Extended EP Search Report dated Dec. 7, 2018, 7 pages.
EP Application No. 18182303.0 Extended EP Search Report dated Dec. 7, 2018, 6 pages.
EP Application No. 18182305.5 Extended EP Search Report dated Dec. 7, 2018, 6 pages.
EP Application No. 18182303.0 Office Action dated Nov. 27, 2020, 4 pages.
European Office Action, dated Nov. 19, 2020; EP Application No. 18 182 305.5-1017; 3 pages.

* cited by examiner

ELEVATOR SENSOR CALIBRATION

BACKGROUND

The subject matter disclosed herein generally relates to elevator systems and, more particularly, to an elevator sensor calibration system for elevator sensor analytics and calibration.

An elevator system can include various sensors to detect the current state of system components and fault conditions. To perform certain types of fault or degradation detection, precise sensor calibration may be needed. Sensor systems as manufactured and installed can have some degree of variation. Sensor system responses can vary compared to an ideal system due to these sensor system differences and installation differences, such as elevator component characteristic variations in weight, structural features, and other installation effects.

BRIEF SUMMARY

According to some embodiments, an elevator sensor calibration system is provided. The elevator sensor calibration system includes one or more sensors operable to monitor an elevator system, an elevator sensor calibration device, and a computing system. The computing system includes a memory and a processor that collects a plurality of baseline sensor data from the one or more sensors during movement of an elevator component, collects a plurality of disturbance data from the one or more sensors while the elevator component is displaced responsive to contact with the elevator sensor calibration device during movement of the elevator component, and performs analytics model calibration to calibrate a trained model based on one or more response changes between the baseline sensor data and the disturbance data.

In addition to one or more of the features described above or below, or as an alternative, further embodiments may include where multiple movement speed profiles are applied to modify a rate of movement while collecting the baseline sensor data and the disturbance data.

In addition to one or more of the features described above or below, or as an alternative, further embodiments may include where more than one instance of the elevator sensor calibration device is contacted during movement of the elevator component.

In addition to one or more of the features described above or below, or as an alternative, further embodiments may include where the elevator sensor calibration device is sized to induce a first vibration profile upon impact between a first portion of the elevator sensor calibration device and the elevator component and to induce a second vibration profile upon impact between a second portion of the elevator sensor calibration device and the elevator component.

In addition to one or more of the features described above or below, or as an alternative, further embodiments may include where the elevator sensor calibration device comprises a rise ramp and a return ramp, and a first angle of the rise ramp is different from a second angle of the return ramp relative to a base portion of the elevator sensor calibration device.

In addition to one or more of the features described above or below, or as an alternative, further embodiments may include where the elevator component is a gib, and the elevator sensor calibration device is coupled to a sill including a sill groove that retains the gib to guide horizontal motion of an elevator door.

In addition to one or more of the features described above or below, or as an alternative, further embodiments may include where the elevator sensor calibration device contacts an elevated portion of the sill when coupled to the sill and positioned to impact the gib.

In addition to one or more of the features described above or below, or as an alternative, further embodiments may include where the elevator sensor calibration device fits at least partially within the sill groove when coupled to the sill and positioned to impact the gib.

In addition to one or more of the features described above or below, or as an alternative, further embodiments may include where the elevator component is a roller, and the elevator sensor calibration device is coupled to a door motion guidance track that guides horizontal motion of an elevator door hung by the roller on the door motion guidance track.

In addition to one or more of the features described above or below, or as an alternative, further embodiments may include where the elevator sensor calibration device wraps at least partially around the door motion guidance track.

According to some embodiments, a method of elevator sensor analytics and calibration is provided. The method includes collecting, by a computing system, a plurality of baseline sensor data from one or more sensors during movement of an elevator component. The computing system collects a plurality of disturbance data from the one or more sensors while the elevator component is displaced responsive to contact with an elevator sensor calibration device during movement of the elevator component. The computing system performs analytics model calibration to calibrate a trained model based on one or more response changes between the baseline sensor data and the disturbance data.

Technical effects of embodiments of the present disclosure include an elevator sensor calibration system with an elevator sensor calibration device for imparting an excitation force to an elevator component responsive to motion, detection of a response change in sensor data upon the elevator component contacting the elevator sensor calibration device, and calibration of a trained model based on the response change to improve fault detection accuracy.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

A detailed description of one or more embodiments of the disclosed apparatus and method are presented herein by way of exemplification and not limitation with reference to the Figures.

Figure 1:
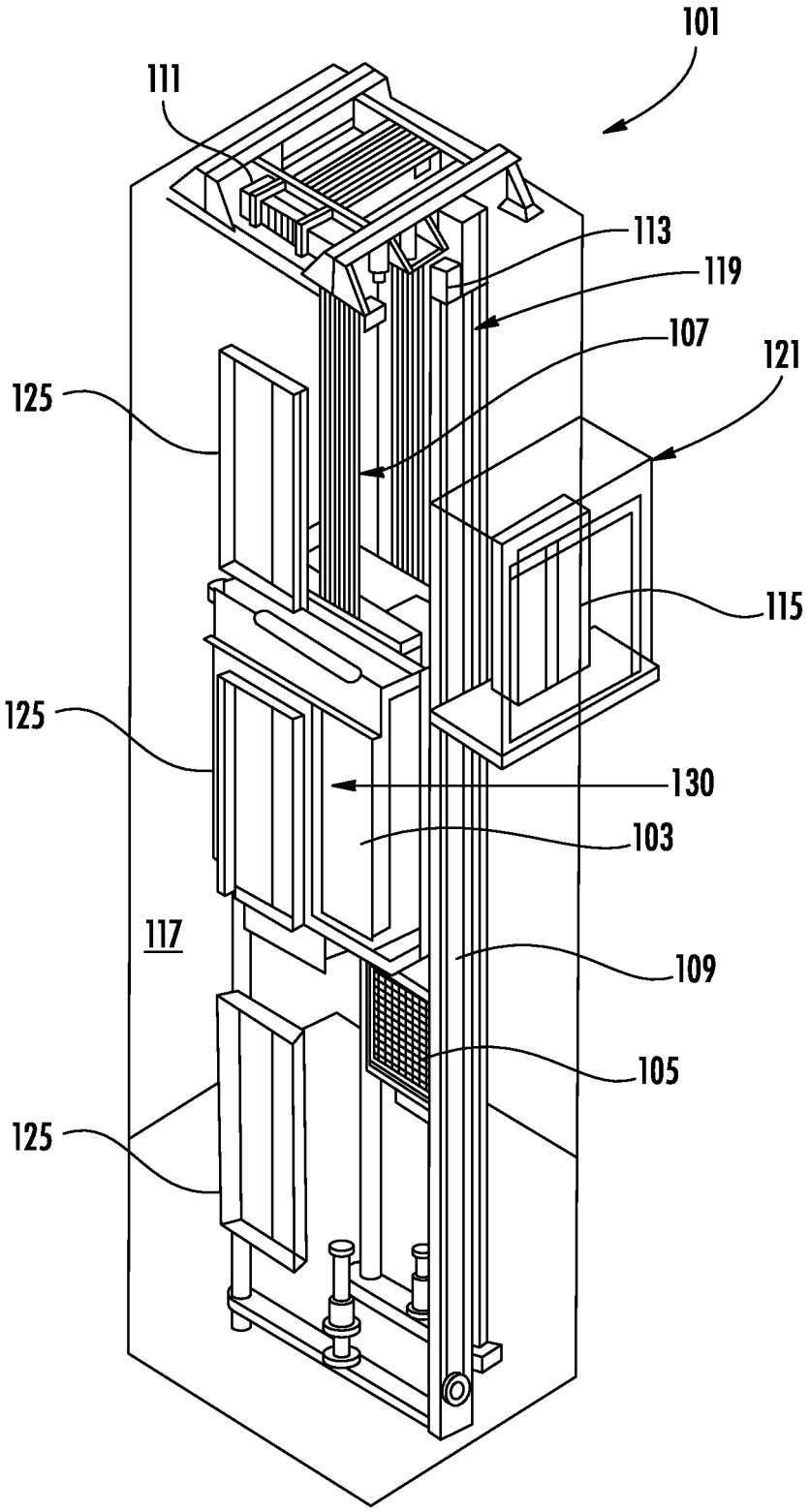
FIG. 1 is a schematic illustration of an elevator system that may employ various embodiments of the present disclosure.

FIG. 1 is a perspective view of an elevator system 101 including an elevator car 103, a counterweight 105, one or more load bearing members 107, a guide rail 109, a machine 111, a position encoder 113, and an elevator controller 115. The elevator car 103 and counterweight 105 are connected to each other by the load bearing members 107. The load bearing members 107 may be, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The load bearing members 107 engage the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control features within the elevator car 103, including, but not limited to, lighting, display screens, music, spoken audio words, etc.

The machine 111 may include a motor or similar driving mechanism and an optional braking system. In accordance with embodiments of the disclosure, the machine 111 is configured to include an electrically driven motor. The power supply for the motor may be any power source, including a power grid, which, in combination with other components, is supplied to the motor. Although shown and described with a rope-based load bearing system, elevator systems that employ other methods and mechanisms of moving an elevator car within an elevator shaft, such as hydraulics or any other methods, may employ embodiments of the present disclosure. FIG. 1 is merely a non-limiting example presented for illustrative and explanatory purposes.

Figure 2:
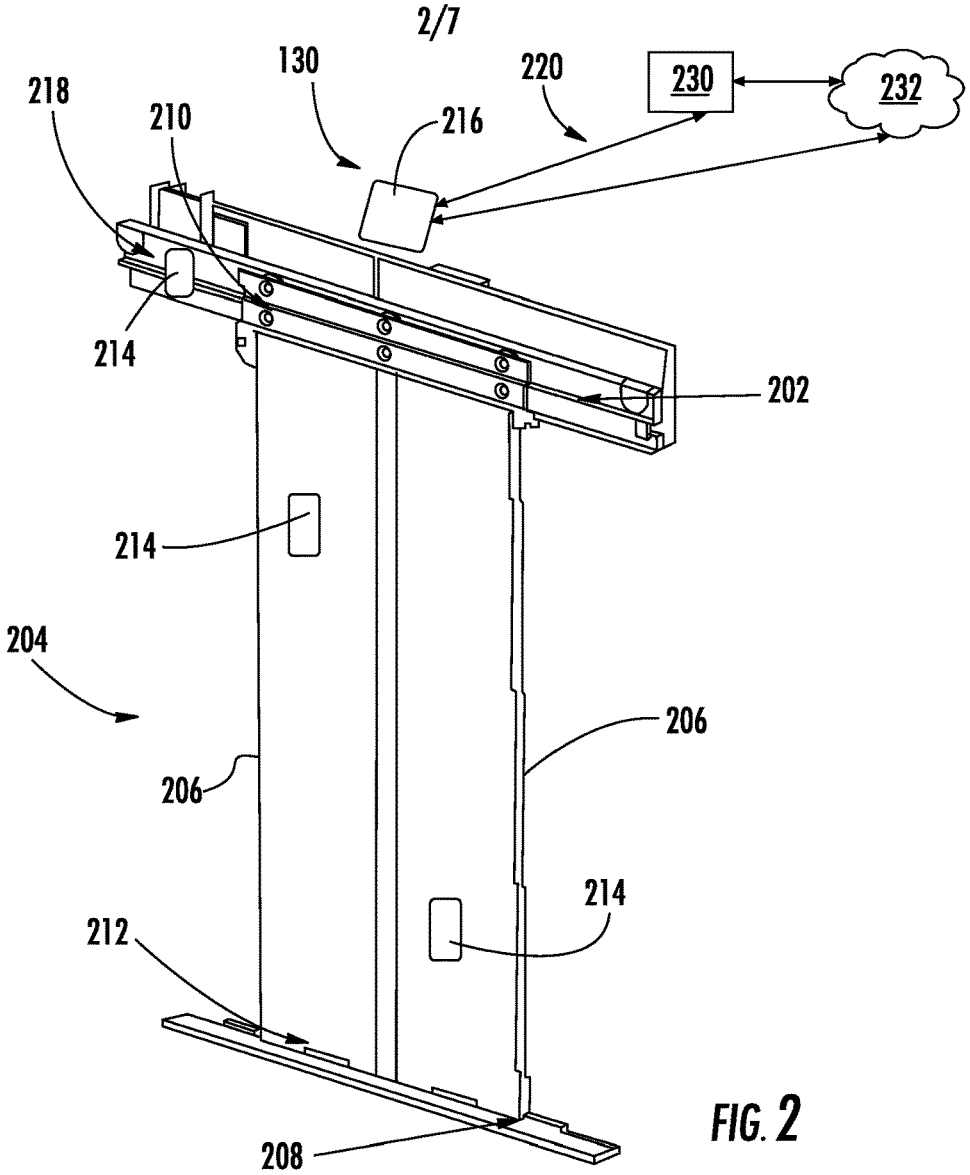
FIG. 2 is a schematic illustration of an elevator door assembly in accordance with an embodiment of the present disclosure.

The elevator car 103 includes at least one elevator door assembly 130 operable to provide access between the each landing 125 and the interior (passenger portion) of the elevator car 103. FIG. 2 depicts the elevator door assembly 130 in greater detail. In the example of FIG. 2, the elevator door assembly 130 includes a door motion guidance track 202 on a header 218, an elevator door 204 including multiple elevator door panels 206 in a center-open configuration, and a sill 208. The elevator door panels 206 are hung on the door motion guidance track 202 by rollers 210 to guide horizontal motion in combination with a gib 212 in the sill 208. Other configurations, such as a side-open door configuration, are contemplated. One or more sensors 214 are incorporated in the elevator door assembly 130. For example, one or more sensors 214 can be mounted on or within the one or more elevator door panels 206 and/or on the header 218. In some embodiments, motion of the elevator door panels 206 is controlled by an elevator door controller 216, which can be in communication with the elevator controller 115 of FIG. 1. In other embodiments, the functionality of the elevator door controller 216 is incorporated in the elevator controller 115 or elsewhere within the elevator system 101 of FIG. 1. Further, calibration processing as described herein can be performed by any combination of the elevator controller 115, elevator door controller 216, a service tool 230 (e.g., a local processing resource), and/or cloud computing resources 232 (e.g., remote processing resources). The sensors 214 and one or more of: the elevator controller 115, the elevator door controller 216, the service tool 230, and/or the cloud computing resources 232 can be collectively referred to as an elevator sensor calibration system 220.

The sensors 214 can be any type of motion, position, force or acoustic sensor, such as an accelerometer, a velocity sensor, a position sensor, a force sensor, a microphone, or other such sensors known in the art. The elevator door controller 216 can collect data from the sensors 214 for control and/or diagnostic/prognostic uses. For example, when embodied as accelerometers, acceleration data (e.g., indicative of vibrations) from the sensors 214 can be analyzed for spectral content indicative of an impact event, component degradation, or a failure condition. Data gathered from different physical locations of the sensors 214 can be used to further isolate a physical location of a degradation condition or fault depending, for example, on the distribution of energy detected by each of the sensors 214. In some embodiments, disturbances associated with the door motion guidance track 202 can be manifested as vibrations on a horizontal axis (e.g., direction of door travel when opening and closing) and/or on a vertical axis (e.g., up and down motion of rollers 210 bouncing on the door motion guidance track 202). Disturbances associated with the sill 208 can be manifested as vibrations on the horizontal axis and/or on a depth axis (e.g., in and out movement between the interior of the elevator car 103 and an adjacent landing 125.

Embodiments are not limited to elevator door systems but can include any elevator sensor system within the elevator system 101 of FIG. 1. For example, sensors 214 can be used in one or more elevator subsystems for monitoring elevator motion, door motion, position referencing, leveling, environmental conditions, and/or other detectable conditions of the elevator system 101.

Figure 3:
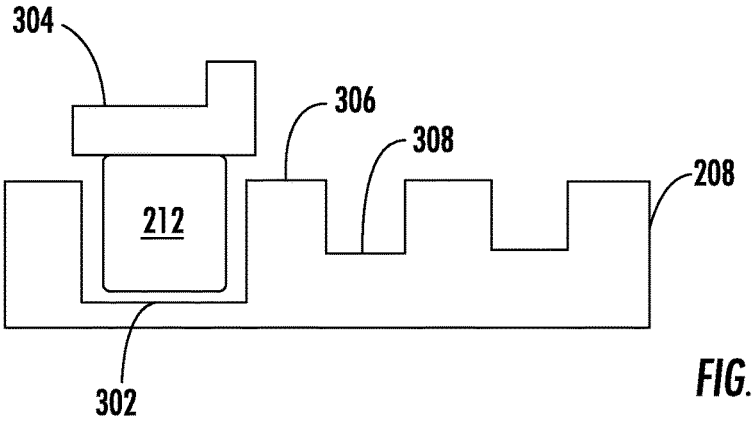
FIG. 3 is a schematic illustration of a sill of an elevator door assembly configured in accordance with an embodiment of the present disclosure.

FIG. 3 depicts the sill 208 in greater detail according to an embodiment. A sill groove 302 can be formed in the sill 208 to assist in guiding horizontal motion of the elevator door 204 of FIG. 2. A shoe 304 can be used to couple the gib 212 to an elevator door panel 206 of FIG. 2. The gib 212 travels within the sill groove 302 to guide and retain the elevator door panel 206. The sill 208 may also include one or more elevated portions 306 and recessed portions 308 that form one or more channels in the sill 208. In the example of FIG. 3, the sill groove 302 is deeper and wider than the recessed portions 308 with respect to the elevated portions 306.

Figure 4:
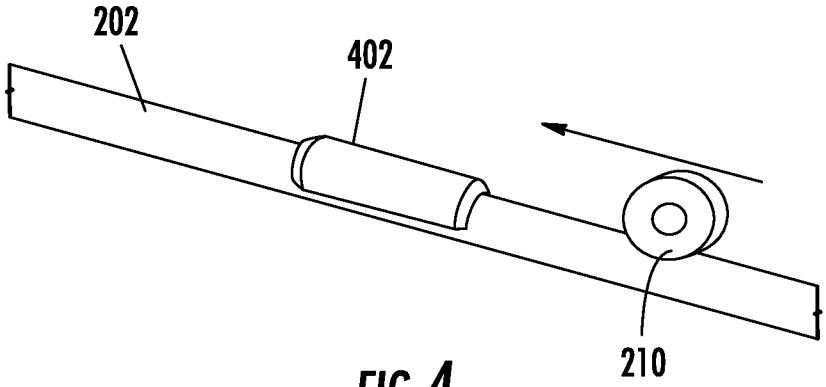
FIG. 4 is a schematic illustration of an elevator sensor calibration device coupled to a door motion guidance track in accordance with an embodiment of the present disclosure.

FIG. 4 depicts an elevator sensor calibration device 402 coupled to the door motion guidance track 202 according to an embodiment. Coupling can be achieved using an adhesive, clamp, screws, and/or other type of fastener. The elevator sensor calibration device 402 is shaped to impart an excitation force to an elevator component such as the elevator door 204 of FIG. 2 responsive to horizontal motion of the elevator door 204 upon contact by an elevator component, such as one of the rollers 210. The excitation force can be detected by one or more of the sensors 214 of FIG. 2 as disturbance data to support calibration of the sensors 214.

Figure 5:
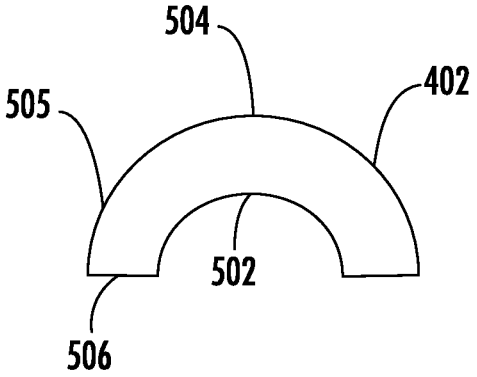
FIG. 5 is a schematic illustration of an end view of an elevator sensor calibration device profile in accordance with an embodiment of the present disclosure.

The elevator sensor calibration device 402 can be sized to wrap at least partially around the door motion guidance track 202. Sizing of the elevator sensor calibration device 402 may be determined based on the desired response characteristics at the point of initial impact of the rollers 210, an amount of desired deflection from the door motion guidance track 202, a length of the disturbance, and a rate of return to the door motion guidance track 202, among other factors. Accordingly, various profiles of the elevator sensor calibration device 402 can be created to induce different responses in the elevator door 204. For instance, as depicted in FIG. 5, the elevator sensor calibration device 402 can include an attachment interface 502 shaped to couple with the door motion guidance track 202. The end view of example profile of FIG. 5 includes a substantially curved transition 505 between an outer surface 504 and a base portion 506 of the elevator sensor calibration device 402, where rollers 210 impact the outer surface 504 and travel in/out of the page in FIG. 5.

Figure 6:
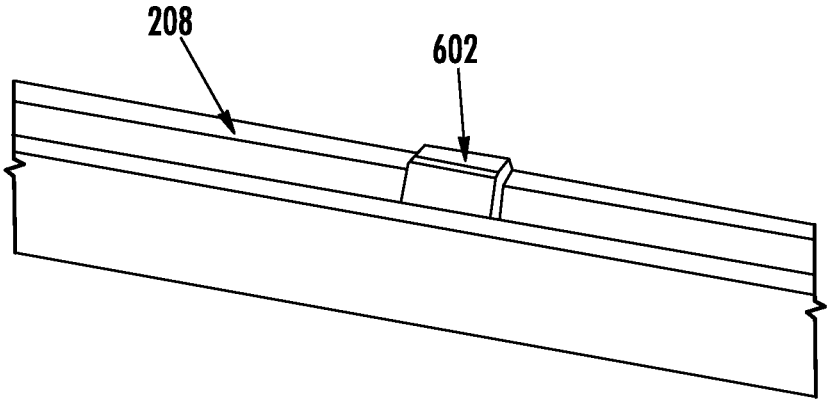
FIG. 6 is a schematic illustration of an elevator sensor calibration device coupled to a sill in accordance with an embodiment of the present disclosure.

FIG. 6 depicts an elevator sensor calibration device 602 coupled to sill 208 according to an embodiment. Coupling can be achieved using an adhesive, clamp, screws, clips and/or other type of fastener or mechanical connection. The elevator sensor calibration device 602 is shaped to impart an excitation force to the elevator door 204 of FIG. 2 responsive to motion of the elevator door 204 upon contact by an elevator component, such as the gib 212 of FIGS. 2 and 3. The excitation force can be detected by one or more of the sensors 214 of FIG. 2 as disturbance data to support calibration of the sensors 214.

The elevator sensor calibration device 602 can be sized to contact an elevated portion 306 (FIG. 3) of the sill 208 when coupled to the sill 208 and positioned to impact the gib 212 and/or shoe 304 (FIG. 3). In some embodiments, the elevator sensor calibration device 602 is sized to fit at least partially within the sill groove 302 (FIG. 3) when coupled to the sill 208 and positioned to impact the gib 212 and/or shoe 304. Sizing of the elevator sensor calibration device 602 may be determined based on the desired response characteristics at the point of initial impact of the gib 212, an amount of desired deflection within the sill groove 302, a length of the disturbance, and a rate of return to normal travel within the sill groove 302, among other factors.

Figure 7:
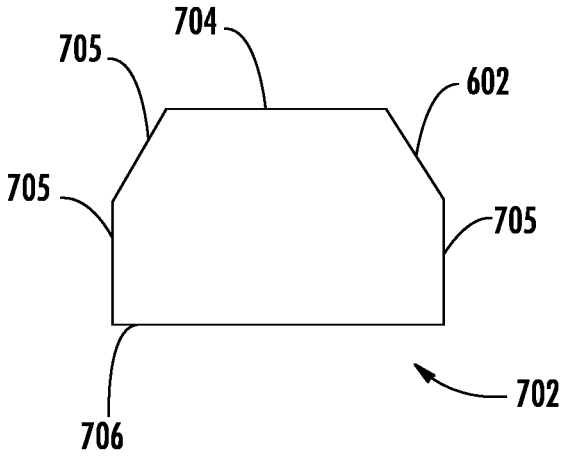
FIG. 7 is a schematic illustration of an end view of an elevator sensor calibration device profile in accordance with an embodiment of the present disclosure.
Figure 8:
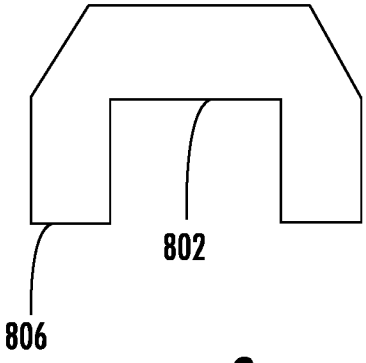
FIG. 8 is a schematic illustration of an elevator sensor calibration device profile in accordance with an embodiment of the present disclosure.
Figure 9:
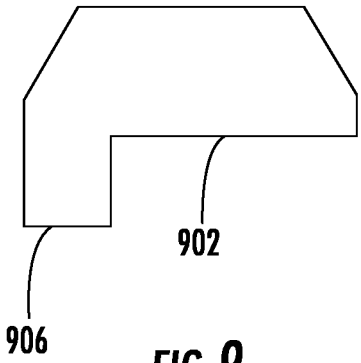
FIG. 9 is a schematic illustration of an elevator sensor calibration device profile in accordance with an embodiment of the present disclosure.

Various profiles of the elevator sensor calibration device 602 can be created to induce different responses in the elevator door 204. For instance, as depicted in FIG. 7, the elevator sensor calibration device 602 can include an attachment interface 702 shaped to couple with the sill 208. The end view of example profile of FIG. 7 includes a plurality of side surfaces 705 between an outer surface 704 and a base portion 706 of the elevator sensor calibration device 602, where the gib 212 (FIG. 3) can impact the outer surface 704 and travel in/out of the page in FIG. 7. The elevator sensor calibration device 602 can be installed in various orientations and positions with respect to the sill groove 302 depending on sizing and placement constraints. In some embodiments, the base portion 706 is substantially planar. In the example of FIGS. 8 and 9, corresponding base portions 806 and 906 have different notch geometries of attachment interfaces 802 and 902 to support contact with different portions of the sill 208 and/or induce different responses in the elevator door 204 (FIG. 2).

Figure 10:
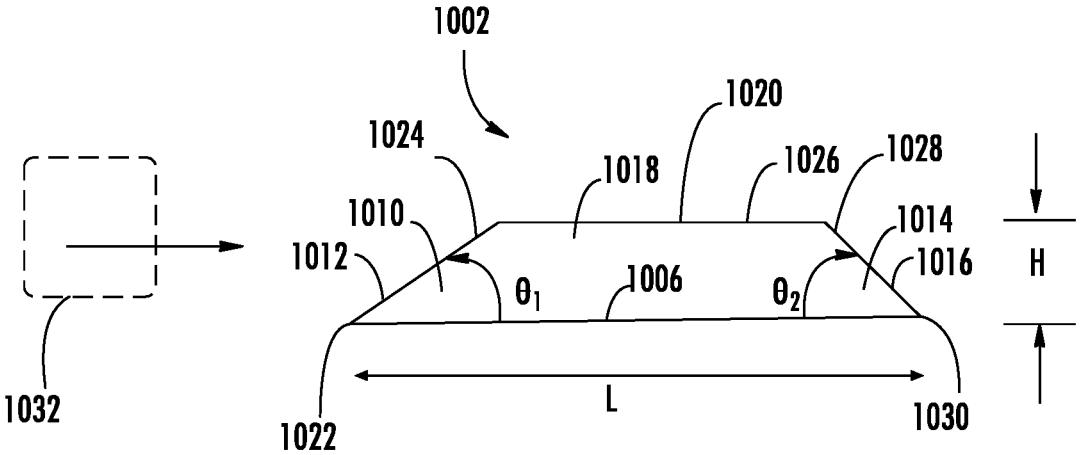
FIG. 10 is a schematic illustration of a side view of an elevator sensor calibration device in accordance with an embodiment of the present disclosure.

FIG. 10 depicts a side view of a lengthwise profile of an elevator sensor calibration device 1002 according to an embodiment. The depicted profile of the elevator sensor calibration device 1002 is an example of a portion of the elevator sensor calibration device 402 (FIG. 4) and/or elevator sensor calibration device 602 (FIG. 6). In the example of FIG. 10, the elevator sensor calibration device 1002 includes a base portion 1006 and a rise ramp 1010 having a first slope 1012 at a first angle ($\Theta_1$) relative to the base portion 1006. The elevator sensor calibration device 1002 also includes a return ramp 1014 having a second slope 1016 at a second angle ($\Theta_2$) relative to the base portion 1006. A mid-portion 1018 is formed between the rise ramp 1010 and the return ramp 1014. An elevator door component impact surface 1020 is formed between a leading impact edge 1022 of the rise ramp 1010, an outer surface 1024 of the rise ramp 1010, an outer surface 1026 of the mid-portion 1018, an outer surface 1028 of the return ramp 1014, and a trailing edge 1030 of the return ramp 1014.

In some embodiments, the first angle ($\Theta_1$) of the rise ramp 1010 is different from the second angle ($\Theta_2$) of the return ramp 1014 to induce different responses. In other embodiments, the first angle ($\Theta_1$) of the rise ramp 1010 is substantially the same as the second angle ($\Theta_2$) of the return ramp 1014 to prevent installation/user errors. In the example of FIG. 10, the outer surface 1026 of the mid-portion 1018 is substantially parallel to the base portion 1006 and offset by a height H. The rise ramp 1010 is an example of a first portion of the elevator sensor calibration device 1002 that can be sized to induce a first vibration profile in one or more elevator door panels 206 (FIG. 2) upon impact with an elevator component 1032 of the elevator door assembly 130

(FIG. 1). The return ramp 1014 is an example of a second portion of the elevator sensor calibration device 1002 that can be sized to induce a second vibration profile in the one or more elevator door panels 206 upon contact with the elevator component 1032 along length L. The elevator component 1032 can be a horizontally translating component, for example, a roller 210 (FIG. 2), a gib 212 (FIG. 2), a shoe 304 (FIG. 3), or other component depending upon the installation location. Although described with respect to elements of elevator door assembly 130, embodiments of the elevator sensor calibration device 402, 602, 1002, can be install on or proximate to many known elevator components of the elevator system 101 of FIG. 1, such as guide rails, pulleys, sheaves, and the like.

Figure 11:
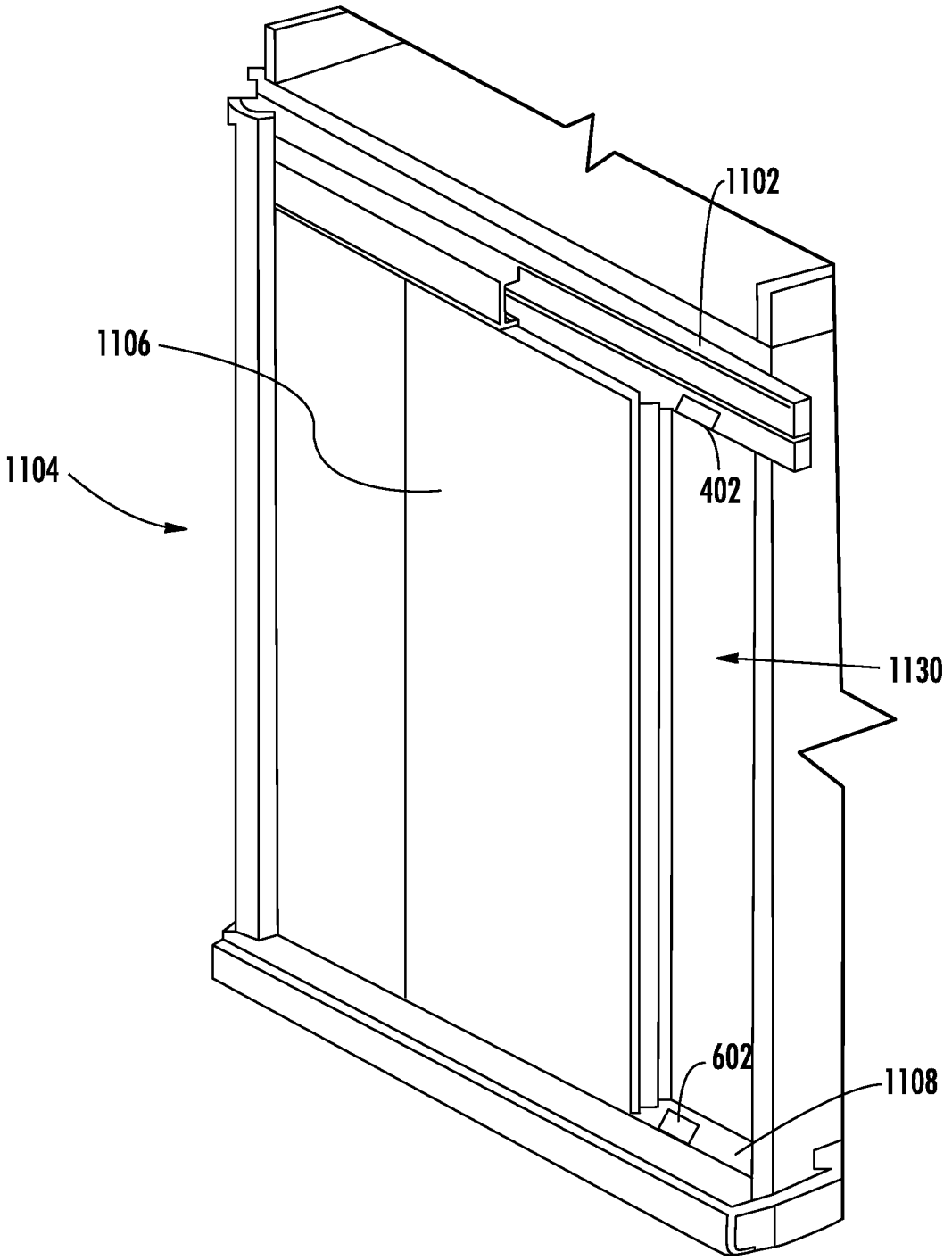
FIG. 11 is a schematic illustration of an elevator door assembly in accordance with an embodiment of the present disclosure.

FIG. 11 depicts an elevator door assembly 1130 according to an embodiment. In the example of FIG. 11, the elevator door assembly 1130 includes a door motion guidance track 1102, an elevator door 1104 including multiple elevator door panels 1106 in a side-open configuration, and a sill 1108. FIG. 11 further illustrates that multiple elevator sensor calibration devices 402, 602 may be installed at the same time on the door motion guidance track 1102 and sill 1108 respectively depending on the desired response profile.

Figure 12:
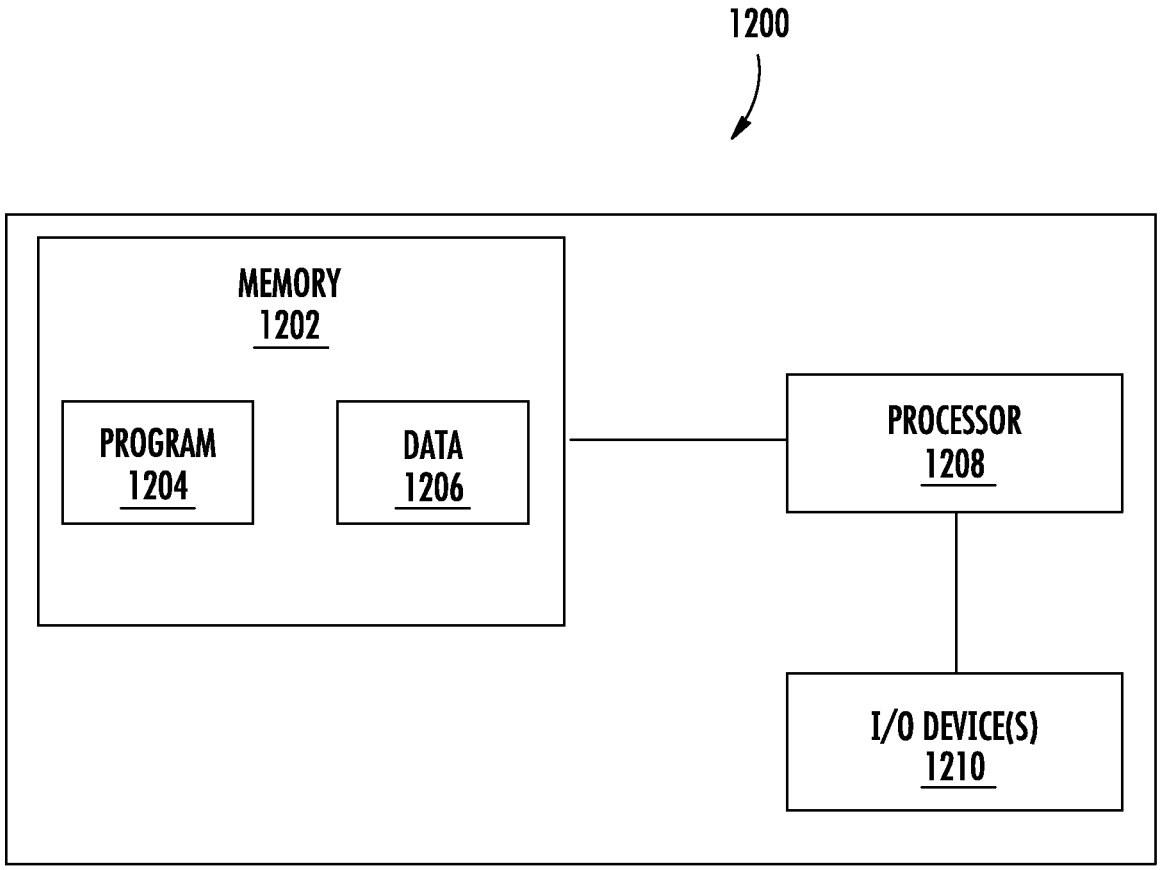
FIG. 12 is a schematic block diagram illustrating a computing system that may be configured for one or more embodiments of the present disclosure.

Referring now to FIG. 12, an exemplary computing system 1200 that can be incorporated into elevator systems of the present disclosure is shown. One or more instances of the computing system 1200 may be configured as part of and/or in communication with an elevator controller, e.g., controller 115 shown in FIG. 1, and/or as part of the elevator door controller 216, service tool 230, and/or cloud computing resources 232 of FIG. 2 as described herein to perform operations of the elevator sensor calibration system 220 of FIG. 2. When implemented as service tool 230, the computing system 1200 can be a mobile device, tablet, laptop computer, or the like. When implemented as cloud computing resources 232, the computing system 1200 can be located at or distributed between one or more network-accessible servers. The computing system 1200 includes a memory 1202 which can store executable instructions and/or data associated with control and/or diagnostic/prognostic systems of the elevator door 204, 1104 of FIGS. 2 and 11. The executable instructions can be stored or organized in any manner and at any level of abstraction, such as in connection with one or more applications, processes, routines, procedures, methods, etc. As an example, at least a portion of the instructions are shown in FIG. 12 as being associated with a control program 1204.

Further, as noted, the memory 1202 may store data 1206. The data 1206 may include, but is not limited to, elevator car data, elevator modes of operation, commands, or any other type(s) of data as will be appreciated by those of skill in the art. The instructions stored in the memory 1202 may be executed by one or more processors, such as a processor 1208. The processor 1208 may be operative on the data 1206.

The processor 1208, as shown, is coupled to one or more input/output (I/O) devices 1210. In some embodiments, the I/O device(s) 1210 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 1210, in some embodiments, include communication components, such as broadband or wireless communication elements.

The components of the computing system 1200 may be operably and/or communicably connected by one or more buses. The computing system 1200 may further include other features or components as known in the art. For example, the computing system 1200 may include one or more transceivers and/or devices configured to transmit and/or receive information or data from sources external to the computing system 1200 (e.g., part of the I/O devices 1210). For example, in some embodiments, the computing system 1200 may be configured to receive information over a network (wired or wireless) or through a cable or wireless connection with one or more devices remote from the computing system 1200 (e.g. direct connection to an elevator machine, etc.). The information received over the communication network can stored in the memory 1202 (e.g., as data 1206) and/or may be processed and/or employed by one or more programs or applications (e.g., program 1204) and/or the processor 1208.

The computing system 1200 is one example of a computing system, controller, and/or control system that is used to execute and/or perform embodiments and/or processes described herein. For example, the computing system 1200, when configured as part of an elevator control system, is used to receive commands and/or instructions and is configured to control operation of an elevator car through control of an elevator machine. For example, the computing system 1200 can be integrated into or separate from (but in communication therewith) an elevator controller and/or elevator machine and operate as a portion of a calibration system for sensors 214 of FIG. 2.

Figure 13:
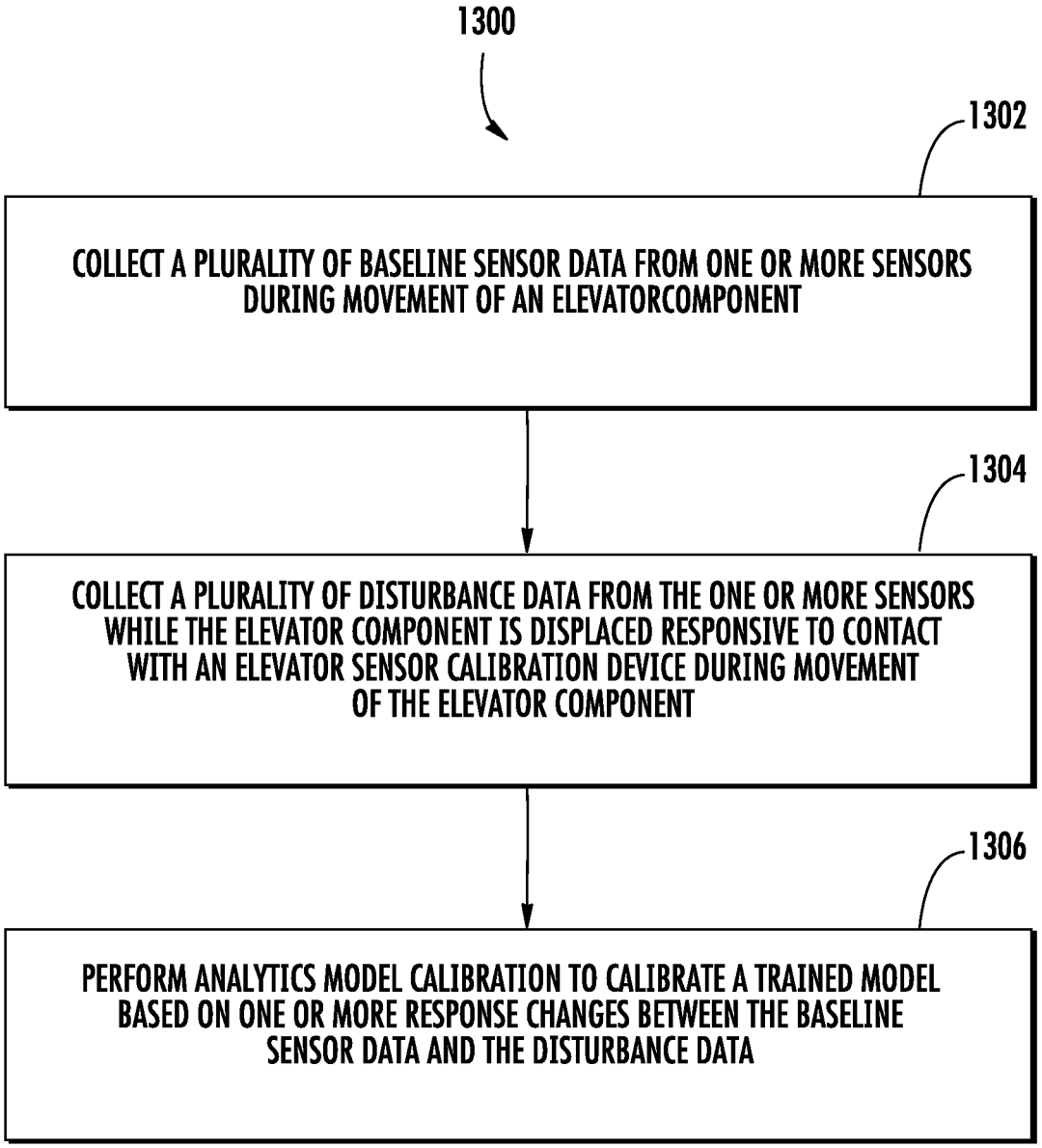
FIG. 13 is a flow process for elevator sensor calibration in accordance with an embodiment of the present disclosure.

The computing system 1200 is configured to operate and/or control calibration of the sensors 214 of FIG. 2 using, for example, a flow process 1300 of FIG. 13. The flow process 1300 can be performed by a computing system 1200 of the elevator sensor calibration system 220 of FIG. 2 as shown and described herein and/or by variations thereon. Various aspects of the flow process 1300 can be carried out using one or more sensors, one or more processors, and/or one or more machines and/or controllers. For example, some aspects of the flow process involve sensors, as described above, in communication with a processor or other control device and transmit detection information thereto.

At block 1302, a computing system 1200 collects a plurality of baseline sensor data from one or more sensors 214 during movement of an elevator component 1032. For example, movement can include cycling an elevator door 204, 1104 between an open and a closed position and/or between a closed and open position one or more times.

At block 1304, the computing system 1200 collects a plurality of disturbance data from the one or more sensors 214 while the elevator component 1032 is displaced responsive to contact with an elevator sensor calibration device 402, 602, 1002 during movement of the elevator component 1032.

At block 1306, the computing system 1200 can perform analytics model calibration to calibrate a trained model based on one or more response changes between the baseline sensor data and the disturbance data. For example, time based and/or frequency based analysis can be used to determine how response changes between the baseline sensor data and the disturbance data differs from an expected performance profile. Various adjustments, such as gains, delays, and the like, can be made to account for in the field variations versus ideal performance characteristics. In some embodiments analytics model calibration applies one or more transfer learning algorithms, such as baseline relative feature extraction, baseline affine mean shifting, similarity-based feature transfer, covariate shifting by kernel mean matching, and/or other transfer learning techniques known in the art, to develop a transfer function for calibrating features of a trained model based on response changes between the baseline sensor data and the disturbance data. The trained model can establish a baseline designation, a fault designation, and one or more fault detection boundaries for the elevator component 1032. The result of applying a learned transfer function to the trained model can include calibration of a fault data signature and one or more detection boundary (e.g., defining fault/no fault classification criteria) according to the specific waveform propagation characteristics observed in the disturbance data. A calibrated fault detection boundary and a calibrated fault designation (i.e., data signature) can represent a calibrated analytics model. A fault designation can include, for instance, one or more of: a roller fault, a track fault, a sill fault, a door lock fault, a belt tension fault, a car door fault, a hall door fault, and other such faults associated with elevator system 101.

In some embodiments, multiple movement speed profiles can be applied to modify a rate of movement (e.g., opening/closing the elevator door 204, 1104) while collecting the baseline sensor data and the disturbance data. Changing the speed and/or acceleration of elevator component 1032 in various calibration tests can further enhance the ability reach particular frequency ranges when impacting the elevator sensor calibration device 402, 602, 1002. Further features may be observed by adjusting the placement position of the elevator sensor calibration device 402, 602, 1002 and/or contacting more than one instance of the elevator sensor calibration device 402, 602, 1002 during movement of the elevator component 1032.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator sensor calibration system comprising:

one or more sensors operable to monitor an elevator system;

an elevator sensor calibration device; and a computing system comprising a memory and a processor that collects a plurality of baseline sensor data from the one or more sensors during movement of an elevator component, collects a plurality of experimental data from the one or more sensors while the elevator component is displaced to follow a modified path defined by the elevator sensor calibration device responsive to the elevator component making physical contact with the elevator sensor calibration device during movement of the elevator component, and performs calibration of a trained model based on the experimental data, wherein the trained model establishes a fault designation of operation of the elevator system.

2. The elevator sensor calibration system of claim 1, wherein multiple movement speed profiles are applied to modify a rate of movement while collecting the baseline sensor data and the experimental data.

3. The elevator sensor calibration system of claim 1, wherein more than one instance of the elevator sensor calibration device is contacted during movement of the elevator component.

4. The elevator sensor calibration system of claim 1, wherein the elevator sensor calibration device is sized to induce a first vibration profile upon impact between a first portion of the elevator sensor calibration device and the elevator component and to induce a second vibration profile upon impact between a second portion of the elevator sensor calibration device and the elevator component.

5. The elevator sensor calibration system of claim 1, wherein the elevator sensor calibration device comprises a rise ramp and a return ramp, and a first angle of the rise ramp is different from a second angle of the return ramp relative to a base portion of the elevator sensor calibration device.

6. The elevator sensor calibration system of claim 1, wherein the elevator component is a gib, and the elevator sensor calibration device is coupled to a sill comprising a sill groove that retains the gib to guide horizontal motion of an elevator door.

7. The elevator sensor calibration device system of claim 6, wherein the elevator sensor calibration device contacts an elevated portion of the sill when coupled to the sill and positioned to impact the gib.

8. The elevator sensor calibration system of claim 6, wherein the elevator sensor calibration device fits at least partially within the sill groove when coupled to the sill and positioned to impact the gib.

9. The elevator sensor calibration system of claim 1, wherein the elevator component is a roller, and the elevator sensor calibration device is coupled to a door motion guidance track that guides horizontal motion of an elevator door hung by the roller on the door motion guidance track.

10. The elevator sensor calibration system of claim 9, wherein the elevator sensor calibration device wraps at least partially around the door motion guidance track.

11. A method comprising:

collecting, by a computing system, a plurality of baseline sensor data from one or more sensors during movement of an elevator component of an elevator system;

collecting, by the computing system, a plurality of experimental data from the one or more sensors while the elevator component is displaced to follow a modified path defined by an elevator sensor calibration device responsive to the elevator component making physical contact with the elevator sensor calibration device during movement of the elevator component; and performing, by the computing system, calibration of a trained model based on the experimental data, wherein the trained model establishes a fault designation of operation of the elevator system.

12. The method of claim 11, further comprising:

applying multiple movement speed profiles to modify a rate of movement while collecting the baseline sensor data and the experimental data.

13. The method of claim 11, wherein more than one instance of the elevator sensor calibration device are contacted during movement of the elevator component.

14. The method of claim 11, wherein the elevator sensor calibration device is sized to induce a first vibration profile upon impact between a first portion of the elevator sensor calibration device and the elevator component and to induce a second vibration profile upon impact between a second portion of the elevator sensor calibration device and the elevator component.

15. The method of claim 11, wherein the elevator sensor calibration device comprises a rise ramp and a return ramp, and a first angle of the rise ramp is different from a second angle of the return ramp relative to a base portion of the elevator sensor calibration device.

16. The method of claim 11, wherein the elevator component is a gib, and the elevator sensor calibration device is coupled to a sill comprising a sill groove that retains the gib to guide horizontal motion of an elevator door.

17. The method of claim 16, wherein the elevator sensor calibration device contacts an elevated portion of the sill when coupled to the sill and positioned to impact the gib.

18. The method of claim 16, wherein the elevator sensor calibration device fits at least partially within the sill groove when coupled to the sill and positioned to impact the gib.

19. The method of claim 11, wherein the elevator component is a roller, and the elevator sensor calibration device is coupled to a door motion guidance track that guides horizontal motion of an elevator door hung by the roller on the door motion guidance track.

20. The method of claim 19, wherein the elevator sensor calibration device wraps at least partially around the door motion guidance track.

* * * * *